United States Patent [19]

Seemann, III

[11] Patent Number: 4,483,267

[45] Date of Patent: Nov. 20, 1984

[54] WOODEN BOAT HULL CONSTRUCTIONS, AND METHOD FOR SUCH CONSTRUCTIONS

[76] Inventor: William H. Seemann, III, 4222 Baronne St., New Orleans, La. 70115

[21] Appl. No.: 449,992

[22] Filed: Dec. 15, 1982

Related U.S. Application Data

[63] Continuation-in-part of Ser. No. 282,278, Jul. 10, 1981, abandoned, which is a continuation of Ser. No. 066,288, Aug. 13, 1979, abandoned.

[51] Int. Cl.[3] ..... B63B 5/02; B63B 5/24

[52] U.S. Cl. ..... 114/357; 114/82; 114/358

[58] Field of Search ..... 156/327, 331.1; 428/425.1; 114/82, 67 R, 357, 358

[56] References Cited

U.S. PATENT DOCUMENTS

| | | | |
|---|---|---|---|
| 2,743,465 | 5/1956 | Vogel | 114/358 |
| 2,929,800 | 3/1960 | Hill, Jr. | 525/403 |
| 3,040,344 | 6/1962 | Theakston | 114/358 |
| 3,538,055 | 11/1970 | Camilleri et al. | 428/425.1 |
| 3,668,051 | 6/1972 | Seemann | 428/231 |
| 3,895,160 | 7/1975 | Seeman | 156/178 |
| 3,983,282 | 9/1976 | Seemann | 428/114 |

FOREIGN PATENT DOCUMENTS

| | | | |
|---|---|---|---|
| 489387 | 5/1975 | Canada | 114/67 R |

*Primary Examiner*—Sherman D. Basinger

[57] ABSTRACT

The hull of a wooden vessel is laminated and provided with an outer plastic skin which provides a hull of high structural strength, and protects the wood interior against rot and attack by marine organisms. In its preferred aspects, a skin of fabric-like fiberglass is chemically bonded (and preferably chemically and mechanically bonded) to a wooden hull constituted of wooden planking at least three-fourths inch in thickness by use of an elastomeric adhesive which, after curing, is capable of stretching at least twice, and preferably from about 3 to about 5 times its length, and the outer surface of the fabric-like fiberglass is saturated with resin, covered with a chopped fiberglass mat, cured, a fairing compound is applied to the exterior of the skin, and the surface is sanded and painted. The laminated structure is highly resistant to stresses produced by expanding, contracting and bending, particularly prevalent in thick wooden hulls, which tend to produce delamination between the skin and the working hull.

11 Claims, 3 Drawing Figures

WOODEN BOAT HULL CONSTRUCTIONS, AND METHOD FOR SUCH CONSTRUCTIONS

RELATED APPLICATIONS

This is a continuation-in-part of application Ser. No. 282,278, filed July 10, 1981, now abandoned, which in turn is a continuation of application Ser. No. 066,288, filed Aug. 13, 1979, now abandoned.

Wooden boats have been known for many centuries, and are still in use throughout the world. Most of the larger boats, often the mainstay of fishing fleets, are of plank construction. Generally the construction is of the lapstrate and carvel type, the planking being secured to a keel with frames or ribs more or less evenly spaced along the length of the hull. These boats, while they have, and remain, highly technologically successful nonetheless become structurally weak with age for which reason many have been replaced by boats of steel construction.

Besides becoming structurally weak, the hulls of wooden boats are subject to rot and attack by marine parasites which has historically plagued both the users and builders of wooden vessels. The destruction caused by rot is particularly acute at, and somewhat above, the water line because the combination of oxygen (air) and wetness causes rotting of the wood to proceed all too rapidly. Below the water line the wooden hull is particularly susceptable to attack by marine organisms.

Fiberglass has been used to cover the hulls of wooden boats but rarely, if ever, have fiberglass coverings persisted for long without cracking and peeling off the hulls. A book "*Covering Wooden Boats With Fiberglass*" (International Marine Publishing Company, Camden, Me. 1981) by Allan H. Vaitses, is devoted entirely to this subject. The author describes at Pages 1 and 2 refiberglassing the bottom of a Rybovich sportfisherman, a boat with an unusual history in that it had been covered with two layers of glass cloth in epoxy resin supposedly some twelve years previously, "a good job to have lasted so long; but one day, not long ago, half of the bottom covering on one side fell away from the hull." The author suggests "Obviously, the epoxy had a good grip on the planking, since almost every square inch of the fiberglass took some of the mahogany [hull] with it. A grainy, chunky veneer came away, leaving the boats bottom striated and pitted, as though she had been dragged over a bed of spikes a hundred yards long. That the epoxy never let go of the wood indicates an excellent bond—." A major difficulty in fiberglassing such hulls is that even the best wooden planking available, radial cut, quarter or rift sawed planking, swells and moves at least 1–2 percent on a working hull. Virtually any wood in swelling will exert at least 800 to 1200 psi of tensile stress and higher. In addition, the forces exerting by the swelling of the wood are of even greater magnitude, and at the junctions between abutting planks there is a tendency to peel off the covering from the hull due to the shifting of abutting planks. Consequently, not too surprisingly, the epoxy-fiberglass mass due to these types of strain is usually in a relatively short time shorn from the hull.

In addition to these forces which act on a working hull, supra, additional forces are produced on the fiberglass-wood bond due to the bending of the planking. Thus, the planking bends in the lateral direction due to the differing moisture contents on the inside and outside of the planking and in the lateral and longitudinal direction due to changes in the hydrostatic loadings caused by vessel loading conditions and wave action. The forces exerted on a hull covering are particularly great where the hull planking is relatively thick. As a consequence of the severity of this problem the "That don't work" attitude in fiberglassing wooden boats has persisted. *Covering Wooden Boats With Fiberglass,* Page 18, supra. The difficulty of achieving a lasting chemical bond between fiberglass sheathing and a wooden hull is well documented by Vaitses in his book, supra, and he has bypassed this difficulty by attaching the sheathing to the wooden hull with mechanical fastenings alone, mechanical fastenings will allow for limited movement between the sheathing and the hull and yet hold these members in reasonable proximity. The problems with this approach are (1) that water will stand between the sheathing and the wooden hull with the attendant possibility of rot, and more importantly (2) it does not utilize the fiberglass in concert with the wooden planking as a structural unit because the horizontal shear forces between the sheathing and the hull are not efficiently transmitted by the mechanical fasteners. Insofar as can be determined no one has ever been able to successfully chemically bond fiberglass sheathing to wooden vessels with relatively thick hulls, notably hulls approaching three-fourth inch in thickness, muchless hulls of three-fourth inch thickness, and greater.

U.S. Pat. No. 2,743,465, which was issued May 1, 1956, to Vogel may be considered as further generally illustrative of the state of the art. Vogel describes a small boat the hull of which is made by edge-to-edge abutting elongate parallel cedar strips running from stern to transom across templets, these extending from the keel to the gunwhales. A liberal coating of a waterproof adhesive, suitably a thermosetting adhesive, e.g. a polyester resin, is applied to the hull, and thereover is placed a glass cloth or glass fiber mats. Whether or not the glass cloth or glass fiber mat will adhere to the hull with any reasonable degree of permanency is questionable; but unquestionably this system of covering a boat is not satisfactory for covering large wooden boats; boats which have hulls approaching three-fourths inch thickness. Thick wooden hulls produce far greater stresses upon the laminar surfaces in expanding, contracting and bending, and all to soon the shear forces between the skin and the flexing wooden surfaces causes delamination of the skin.

Australian Pat. No. 489,387, granted Dec. 9, 1977 to Klauss Zondek, albeit it does not relate to fiberglassing wooden boats may also be considered as of some relevance. The Zondek patent also discloses a small boat, inclusive of wooden hulls of plank or plyboard. In the construction of the boat, an elastomer adhesive such as a neoprene composition or adhesive "Scotch" (registered trademark) tape is placed upon the hull, and a thin metal foil, or foil of thickness ranging from 0.05 to 0.5 mm, is then bonded to the hull. It is disclosed that the thin metal foil skin protects the hull from fouling by marine growths. Whatever the merits of this system for protecting the boat against marine organisms, it is quite obvious that the metal skin is lacking in mechanical strength. The system adds no significant structural strength to the boat, and inter alia, obviously, the metal foil is incapable of contributing significant mechanical strength to the vessel as does a fiberglass sheathing which is by practice of much greater thickness and strength. Furthermore, such a thin foil is incapable of inducing high shearing and tensile stresses between itself and the hull which it covers because it has relatively little tensile and flexural strength in itself. Therefore the foil will stretch and bend as necessary to conform with the hull and will not tend to pull away from the hull as does a fiberglass sheathing. Zondek, of course, in his preference for contact cement or "Scotch" (trademark) tape type of adhesives indicates that he is concerned with ease of application of the foil to the hull and not with the stresses between the foil and the hull.

It is, accordingly, the primary objective of the present invention to overcome these and other shortcomings of the prior art by providing novel hull structures which are of high structural strength, and impervious to rotting and attack by marine organisms; and, as well, a novel method for the construction of such hulls.

It is a particular, and further object to provide novel, durable, long-lasting wooden hull constructions which compare favorably with, and in some aspects even surpass the quality of both wooden and non-wooden hulls, and a method for the construction of such hulls.

These objects and others are achieved in accordance with the present invention embodying an improved laminated structure comprising a wooden hull equal to or greater than three-fourths inch in thickness, a fiberglass skin, or coating having an outer surface and an inner surface, the inner surface of the fiberglass skin, or coating being bonded via an elastomeric adhesive to the outer surface of said wooden hull in water-tight proximity to provide greater structural strength, and an outer skin which protects the wooden hull against rot and marine organisms.

The wooden portion of the laminated structure is preferably at least three-fourths inch in thickness, and generally ranges to about six inches, and greater. More preferably, the wooden planking ranges from about one and one-half inches to about four inches, and most preferably from about one and one-half inches to about three inches in thickness. Commonly, wooden planking of three-fourths inch or greater thicknesses is employed on boats up to about thirty feet length, and wooden planking of two inch or greater thickness is employed in boats of up to about seventy-five feet in length. Wooden planking of about two to two and one-half inch thickness is commonly used in large trawlers, and wooden planking of from three to four inches thickness is commonly used in North Sea trawlers. The laminated structure of this invention has been found admirably successful in the construction of boats of these sizes, and types.

The elastomeric adhesive is necessarily one which provides an elongation of at least one hundred percent (100%) of its cured length, and preferably one which is capable of stretching from about 300% to about 500% of its cured length. The adhesive must have the capacity to stretch after curing. A rigid, or less elastic adhesive whatever its tenacity or holding power will not suffice, and will all too soon fail by permitting the forces which set on the hull and skin to delaminate, peel or shear off the skin and outer surface of the hull itself.

In its preferred form the wooden hull is covered with a high strength fiberglass skin which completely covers at least that portion of the hull wetted by, and in contact with the water. The fiberglass skin not only protects the hull against rot and marine organisms, but also increases the life and strength of the boat as well as dramatically reducing the cost of maintainance. The fiberglass skin for added strength is preferably secured to the hull by a combination of mechanical fastenings, and an elastomeric adhesive which chemically bonds the fiberglass skin to the hull. The fiberglass skin, after it is secured and bonded by the use of adhesive to the hull is generally, and preferably, saturated with resin, covered with a chopped strand mat to provide added strength, a fairing compound is applied to the outside surface, or exterior of the skin, and the surface is then sanded and painted to provide a smooth, and even a glossy finish. This can be done without any necessity of tipping the boat on its side to complete the construction; which is a particularly preferred advantage when laminating large boats.

These features and others will be better understood by reference to the following detailed description of the invention, and to the attached drawings to which reference is made. In the drawings, similar numbers are used to represent similar components in the different figures, or views, and subscripts are used to designate a plurality of similar or analogous parts.

Figure 1:
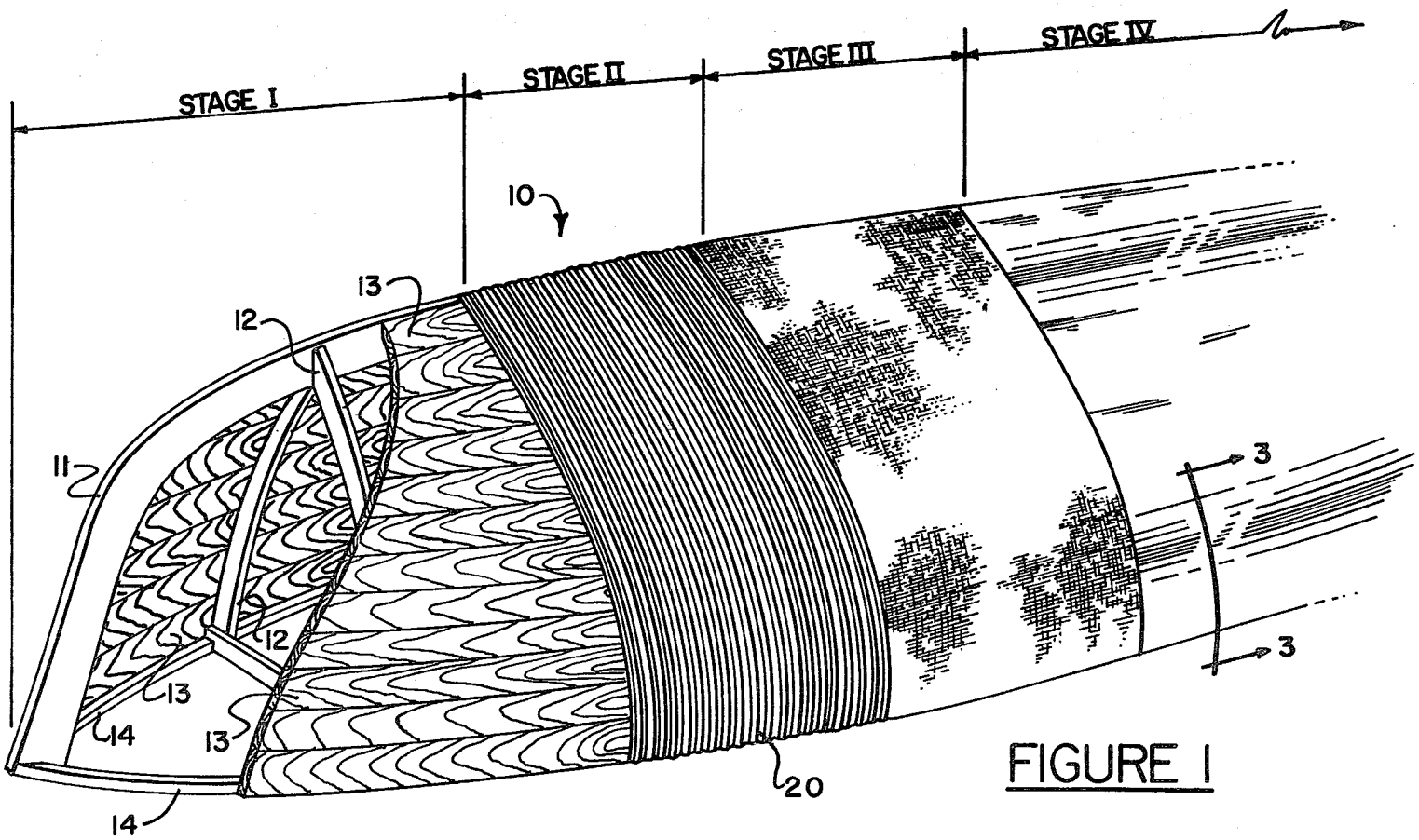
FIG. 1 is a perspective view of the front portion of a boat hull in its various stages of construction in accordance with a preferred method of practicing the present invention.

Referring generally to FIG. 1 there is shown a boat hull 10 comprised of a keel 11 and substantially evenly spaced transverse frames 12 over which is laid, and to which is secured a series of longitudinally laid wooden planks 13. The edges of the wooden planks 13 are smooth, and they are placed edge to edge and fastened to the frames 12. The outer surface of the wooden planking 13 is sandblasted or sanded to provide a clean, smooth, uniform surface.

In accordance with the present method, the outer prepared surface of the otherwise conventional carvel planking 13 of the boat hull 10 is coated with an elastomeric adhesive to complete Stage 1 of the overall construction. In accordance with Stage 2, the wooden planking 13 is covered with a fiberglass planking, preferably a fabric-like multi-plie fiberglass planking as subsequently described by reference to FIG. 2; and which type of planking is disclosed in my U.S. Pat. Nos. 3,668,051; 3,895,160 and 3,983,282, pertinent portions of which are herewith incorporated by reference.

Figure 2:
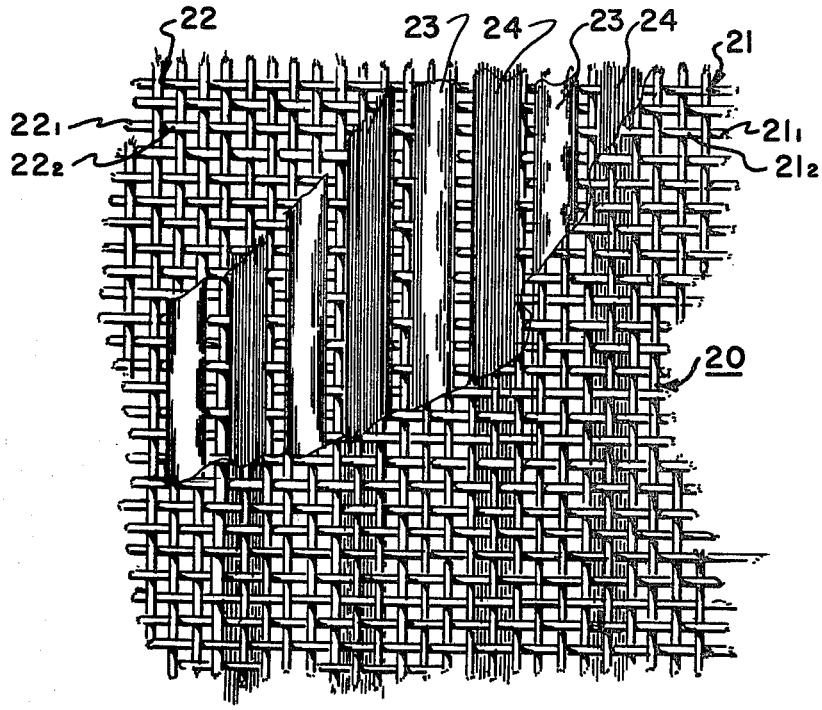
FIG. 2 is a top view, in partial section of a representative segment of a fabric-like multi-plie fiberglass planking used in the construction of the boat.

The multi-plie fabric-like construction represented in FIG. 2 is capable of assuming the shape of a compound-curved object, notably that of a boat hull on which it is placed, and in accordance with the present invention the inner surface thereof can be tightly, chemically bonded to the outer surface of the wooden planking 13 by use of an elastomeric adhesive. The multi-plie fabric-like material can thereafter serve as a base for the support of resins or liquified plastics added thereupon and then cured and hardened as on initial step in the formation of a laminated hull structure. The resin, upon hardening, can be further coated with additional layers of resin, fiberglass and the like, as desired, to form an outer skin of the thickness desired.

Referring specifically to FIG. 2 there is depicted a segment of two-plie fabric 20 useful for bonding to the planking 13. The fabric 20 embodies an upper plie 21 and lower plie 22, the upper plie 21 being comprised of warp yarns $21_1$ and filler yarns $21_2$ while the lower plie 22 is comprised of warp yarns $22_1$ and filler yarns $22_2$. The plies are necessarily of flexible or pliable material, such as a porous film or plastic, and can be of the same or of a different material. The plies 21, 22 are separated and retained substantially parallel, one member with respect to the other, by a plurality or series of spaced apart elastic, resilient or springy elements 23 sandwiched between and, preferably, bonded to the individual plies. A series of rovings 24 are contained within the voids between the individual elements 23, the rovings imparting tensile strength to the fabric.

In its preferred form, the individual yarns of plies 21, 22 of fabric 20 can be constituted of virtually any fiber which is compatible with the resin coating to be applied and sufficiently pliable to permit substantially unimpeded or free displacement of the individual elements 23, including movement toward or away from one another, or in a direction lateral or transverse to the major axes of said elements 23, but most particularly movement in a longitudinal direction. It is thus essential that the yarns which are transverse to the major axes of the elements 23, in this instance filler yarns $21_2$, $22_2$, be flexible to permit movement of the elements 23 in longitudinal direction which is essential in assuming, with the plies 21, 22 the necessary compound-curved shape. The warp yarns $21_1$, $21_2$ can also be flexible, if desired, the individual elements 23 being selected to provide the necessary stiffness in the longitudinal direction, or in the direction of the major axes of elements 23. Suitably, the yarns constituting plies 21, 22 are composed in whole or in part of natural or synthetic fibers such as cotton, rayon, Dacron, nylon, Orlon, acetate, Acrilan, Creslan, Dynel, Fortrel, Kodel, wool and the like. A yarn constructed in whole or in part of glass fibers, particularly the latter, is especially preferred.

The springy elements 23 are in the form of elongate members oriented in parallel relationship, one member relative to another. They are suitably constructed of a solid, rigid or semi-rigid plastic, preferably hardened or cured resins within which fibrous textile materials are incorporated, suitably as yarns or rovings. The high ratio of the surface area relative to the cross-sectional area of the individual fibers, are thoroughly wetted by resin or liquid plastic and set, cured or hardened so that the individual fibers are strongly bonded together with the plastic which serves as a matrix for the fibers, this providing sufficient strength to prevent the fibers from being pulled apart or broken loose one from another when the finished structure is subjected to great stress.

Figure 3:
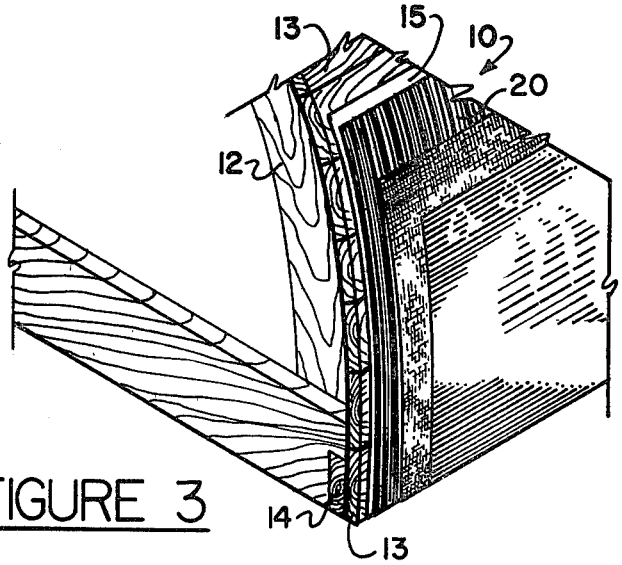
FIG. 3 is a section view taken along line 3—3 of FIG. 1 this view representing a completed laminated section taken from the hull of the boat.

Fiberglass rovings are particularly preferred for use in constructing the elements 23. Glass rovings can be sprayed, dipped or otherwise impregnated with various resins, shaped as desired, and the resin then solidified and hardened to form said elements. Glass roving thus impregnated with various resins, e.g., epoxy resins, polyesters, phenolic or melamine resins, of the thermosetting type, in a preferred embodiment, can thus be heat set to form rigid shapes suitable for use as springy elements. By replacement of the resin impregnated yarns of various types between the plies 21, 22 in desired orientation, the springy elements 23 can, in either event, be simultaneously bonded to the enveloping plies 21, 22 at the time of setting. Additionally the voids or spaces between the elements 23 are filled with glass yarn or rovings 24, the function of which is to impart tensile strength to the fabric. The fabric 20 is preferably laid so that the major axes of the springy elements 23 and rovings 24 are aligned in the direction that the greatest tensile strength is needed. To provide the greatest structural strength to the wooden boat hull the fabric 20 is laid, as depicted in FIGS. 1 and 3, with the springy elements 23 and rovings 24 running from the keel to the gunwhales.

Referring again to FIG. 1, and considering again Stage 2 of the construction, the fabric 20 is applied so that the major axes of the springy elements 23 and rovings 24 are vertically aligned from gunwhale 14 to keel 11, or in a direction perpendicular to the direction of the wooden planking 13.

As a first step, as depicted in accordance with Stage 1, the outer surface of the planking 13 is wetted with an elastomeric adhesive 15. The inner surface or face of the fabric 20, as shown by reference to Stage 2, is then pressed against the uncured adhesive 15, and the fabric 20 then secured to the planking 13 by fastening same thereto with heavy metal staples. The tenacity of the staples, initially, and the adhesive after curing permanently adheres the fabric to the planking 13, and virtually eliminates separation of the fabric from the wood. In accordance with Stage 3, with the fabric 20 secured in place, a coat of wax-free polyester laminating resin is brushed or sprayed thereover and the resin then covered with chopped fiberglass fibers and the coating then allowed to harden; this procedure being repeated until the coating has been built to the desired thickness. A fairing compound is then applied, and the structure is sanded and painted as represented in Stage 4.

The elastomeric adhesive is one which necessarily provides an elongation of at least one hundred (100%) of its cured length, and preferably is capable of stretching for about 300% to about 500% of its cured length. In other words, the adhesive after curing, or setting, is sufficiently elastic that it is capable of stretching to at least double its length under application of a force, and preferably is capable of stretching from about 3 times to about 5 times its length. The tensile strength of the elastomeric adhesive must be at least about 50 pounds per square inch (psi), and preferably ranges from about 100 psi to about 150 psi. The elastomeric adhesive is preferably one which will bond to damp wood, and wood of high oil content. Dampness is an environmental factor which is difficult to eliminate, and many of the better woods useful in boat building are of high oil content, e.g., cedar, teak, pitch pine and the like.

The elastomeric adhesive is thus one which can be considerably elongated under the high stresses and impacts applied to a "working" hull, and yet it will adhere with great tenacity to both the plastic skin and the wooden planks. Adhesives which possess lesser elasticity when subjected to such differential forces all too soon permit the skin to work loose from the wood, or delaminate, and points of delamination will spread, particularly thickness, e.g., wood of thickness ranging three-fourths inch and greater; and more especially when the skin is joined to damp or oily wood.

Elastomeric polyurethane is preferred as an adhesive for bonding the fabric 20 to the planking 13. Unlike many adhesives, it bonds strongly to both the fiberglass and the wood planking, even when the wood planking is wetted with water, or when the wood has been pretreated as is conventional in the preparation of marine planking. The adhesive generally begins to cure after about four hours from the time of application. Because the adhesive is capable of stretching as much as 300 percent, or more, the structure can be subjected to the tremendous stresses of a working hull, as occasioned by contractions and expansions without breakage of the bond.

Other suitable elastomeric adhesives, or sealants, are such elastomers or classes of elastomers as isobutylene isoprene, polyvinyl chloride, ethylenevinyl acetate, styrene butadiene, the silicones, polysulfides, polymercaptane, polyisobutylenes, acrylics, latexes, chloroprenes, alkyls, nitriles, polybutenes, epoxys, polyesters, epoxy-polysulfides, vinyl esters or the like.

The preferred chopped strand mat is a relatively low strength, e.g., 11,000 psi tensile, omnidirectional fiberglass. It is particularly useful in laminates and assists in bonding the different layers of fabric.

A preferred fairing compound for smoothing the surface is constituted of a polyester resin, industrial talc and glass micro-spheres. This compound is easily applied and dries to a hard, resistant surface. The surface is readily sanded to a high smoothness, the time required for this step being dependent upon the surface finish desired. The finished surface is then painted.

It is apparent that various modifications and changes can be made, e.g., as in the size, shape, and to some extent in the materials of construction, without departing the spirit and scope of the invention.

Having described the invention what is claimed is:

1. In apparatus characterized as a vessel useful for navigating a body of water, the combination which comprises a laminated structure comprised of a wooden hull equal to or greater than three-fourths inch in thickness, a high strength fiber reinforced plastic skin which completely covers at least that portion of the hull wetted by, and in contact with the water, having an outer surface and an inner surface, and an elastomeric adhesive which after curing is capable of stretching at least 100 percent of its length on application of a force and which chemically bonds the outer surface of the wooden hull to the inner surface of the fiber reinforced plastic skin to maintain said fiber reinforced plastic skin in water-tight proximity to the hull to provide increased structural strength, and a skin which protects the wooden hull aginst rot and marine organisms.

2. The apparatus of claim 1 wherein the high strength fiber reinforced plastic skin is of multi-plie fabric-like construction reinforced with high strength fiber yarns.

3. The apparatus of claim 1 wherein the outer surface of the fiber reinforced plastic skin is saturated with resin, covered with a chopped fiber glass mat, cured, a fairing compound is applied to the exterior of the fiber reinforced plastic skin, and the surface is sanded and painted.

4. The apparatus of claim 1 wherein the high strength fiber reinforced plastic skin is a fabric-like structure comprised of two plies, an inner plie which is chemically bonded to the hull of the boat by the adhesive and an outer plie both of which are characterized, prior to the time the adhesive is cured, as flexible material between which is sandwiched a series of spaced apart, parallel aligned, springy plastic elements of elongate shape, each constructed and reinforced with glass fibers impregnated with resin and cured to form a semi-rigid material, each plastic element being bonded to the inner and outer plies, and the voids between adjacent elements contain additional glass fibers as yarns or rovings.

5. The apparatus of claim 4 wherein the major axes of the elongate springy plastic elements of the fabric-like structure constituting a part of the high strength fiberglass skin are vertically aligned upon the hull from the gunwhale to the keel of the boat.

6. The apparatus of claim 1 wherein the wooden hull portion of the laminated structure is comprised of wooden planking which ranges from about one and one-half inches to about four inches in thickness.

7. The apparatus of claim 1 wherein the wooden hull is of carvel construction, the thickness of the wooden hull ranges from about one and one-half inches to about four inches, and the adhesive after curing is capable of stretching from about 3 times to about 5 times its length.

8. The apparatus of claim 1 wherein the wooden hull is of carvel construction, the thickness of the wooden hull ranges from about one and one-half inches to about four inches, the high strength fiber reinforced plastic skin is a fabric-like structure comprised of two plies, an inner plie which is bonded to the hull by an adhesive capable of stretching from about 3 times to about 5 times its length and an outer plie both of which are characterized prior to the time the adhesive is cured, as flexible material between which is sandwiched a series of spaced apart, parallel aligned, springy plastic elements of elongate shape, each constructed and reinforced with glass fibers impregnated with resin and cured to form a semi-rigid material, each plastic element being bonded to the inner and outer plies, and the voids between adjacent elements contain additional glass fibers as yarns or rovings.

9. The apparatus of claim 8 wherein the adhesive is elastomeric polyurethane.

10. A method for the construction of the hull of a vessel useful for navigating a body of water which comprises applying an elastomeric adhesive which after curing is capable of stretching at least 100 percent of its length on application of a force upon the outer surface of the wooden hull of the vessel, applying upon the wooden hull of the vessel a high strength fiber reinforced plastic skin, the inner surface of which is tightly pressed against the elastomeric adhesive, curing the elastomeric adhesive so that said elastomeric adhesive is chemically bonded to the outer surface of the wooden hull in water-tight proximity to provide increased structural strength, and a skin which protects the wooden hull against rot and marine organisms.

11. The method of claim 10 wherein the high strength fiber reinforced plastic skin is mechanically fastened to the hull as well as chemically bonded thereto by the adhesive, the outer surface of the reinforced plastic is saturated with resin, covered with a chopped fiber glass mat, cured, a fairing compound is applied to the exterior of the skin, and the surface is sanded and painted.

* * * * *